US005719606A

United States Patent [19]

Kigawa et al.

[11] Patent Number: 5,719,606

[45] Date of Patent: Feb. 17, 1998

[54] INK JET HEAD INCLUDING A CONNECTOR HAVING A JOINING COMPONENT WITH A PLURALITY OF ELECTROCONDUCTIVE PARTICLES CONTAINED THEREIN AND A METHOD OF PRODUCING SAID INK JET HEAD

[75] Inventors: Keisuke Kigawa; Tomoo Ikeda, both of Saitama-ken; Masayasu Uga, Tokyo; Yoshiyuki Nagashima, Saitama-ken; Hisato Hiraishi, Tokyo, all of Japan

[73] Assignee: Citizen Watch Co., Ltd., Tokyo, Japan

[21] Appl. No.: 367,138

[22] PCT Filed: Jul. 5, 1993

[86] PCT No.: PCT/JP93/00921

§ 371 Date: Feb. 28, 1995

§ 102(e) Date: Feb. 28, 1995

[87] PCT Pub. No.: WO94/01284

PCT Pub. Date: Jan. 20, 1994

[30] Foreign Application Priority Data

Jul. 3, 1992 [JP] Japan ..... 4-198935
Sep. 11, 1992 [JP] Japan ..... 4-267856

[51] Int. Cl.[6] ..... B41J 2/045; B41J 2/14

[52] U.S. Cl. ..... 347/69; 347/50; 347/68

[58] Field of Search ..... 347/50, 69, 68, 347/94, 86; 361/774, 776, 779, 803; 439/66, 91, 591; 156/306.6, 306.9, 307.1; 257/40; 174/84 R, 117 A

[56] References Cited

U.S. PATENT DOCUMENTS

| | | | |
|---|---|---|---|
| 4,216,477 | 8/1980 | Matsuda et al. | 347/70 |
| 4,814,040 | 3/1989 | Ozawa | 439/91 |
| 4,879,568 | 11/1989 | Bartky et al. | 347/69 |
| 5,045,249 | 9/1991 | Jin et al. | 439/91 |
| 5,197,892 | 3/1993 | Yoshizawa et al. | 347/50 |
| 5,225,996 | 7/1993 | Basavanhally et al. | 361/774 |
| 5,360,943 | 11/1994 | Mori et al. | 174/84 R |
| 5,420,620 | 5/1995 | Tamura | 347/50 |
| 5,500,537 | 3/1996 | Tsumura et al. | 257/40 |

FOREIGN PATENT DOCUMENTS

| | | |
|---|---|---|
| 53-12138 | 4/1978 | Japan . |
| 59-159358 | 9/1984 | Japan . |
| 61-59914 | 12/1986 | Japan . |
| 63-252750 | 10/1988 | Japan . |
| 4-182133 | 6/1992 | Japan . |

*Primary Examiner*—Benjamin R. Fuller
*Assistant Examiner*—L. Anderson
*Attorney, Agent, or Firm*—Wenderoth, Lind & Ponack

[57] ABSTRACT

An ink jet head of an ink jet printer of a drop-on-demand type achieves mounting or connection between a driving electrode and an external electrode easily and surely and at the same time reduces revolution of a piezoelectric material during driving. Between the driving electrode with an insulating film and the external electrode is provided an electrical joining component containing electroconductive particles that are harder than the insulating film and that have a particle diameter larger than the thickness of the insulating film. At the bottom part of a slot in a piezoelectric material that forms an ink chamber and pressure chamber is provided a concave portion having a shape formed of combined at least two lines or surfaces. A part of a surface causing a revolution is converted to a component causing a shearing mode.

24 Claims, 11 Drawing Sheets

INK JET HEAD INCLUDING A CONNECTOR HAVING A JOINING COMPONENT WITH A PLURALITY OF ELECTROCONDUCTIVE PARTICLES CONTAINED THEREIN AND A METHOD OF PRODUCING SAID INK JET HEAD

This application is a 371 of PCT/JP93/00921 filed Jul. 5, 1993.

BACKGROUND OF THE INVENTION

1. Technical Field

The present invention relates to an ink jet head of a drop-on-demand (DOD) type, and, more specifically, relates to an ink jet head of a piezoelectric type.

2. Background Art

Use of ink jet printers of non-impact printers is expanding in the market since such printers operate on a simple principle and are suitable for color printing. It can be said that an ink jet printer of a so-called DOD type that jets ink drops only on formation of dots is the leading of such printers.

Typical examples of a DOD type printer are a kaiser type disclosed in Japanese Patent Publication No. 12138/1978 and a thermal jet type disclosed in Japanese Patent Publication No. 59914/1986. Both have a very difficult problem: the former is hard to miniaturize, and in the latter ink is burned due to high heat imparted thereto.

To avoid such problems, there have been proposed an expanding mode type disclosed in Japanese Laid-Open Patent Publication No. 159358/1984 and a shearing mode type disclosed in Japanese Laid-Open Patent Publication No. 252750/1988 using a chip of a piezoelectric material.

A shearing mode type will be described briefly with reference to FIG. 14 and FIG. 15. A pressure chamber 1*a* is constituted by forming a slot in a piezoelectric base 1 and covering it with a flat plate-like upper lid 2. A driving electrode 4 is provided on an inner wall of slot 1 and voltage is applied onto a barrier 1*c* that is a part of the piezoelectric base 1 to deform barrier 1*c*. If the polarization of the piezoelectric base 1 is left in the direction to the upper lid 2 from base 1, shearing deformation shown by broken lines occurs when an electric field by voltage is in the direction of shown arrows. The state of the barrier 1*c* after deformation is shown on an exaggerated scale to illustrate the deformation of the barrier clearly. The volume of the pressure chamber 1*a* is reduced by such deformation and ink supplied into chamber 1*a* is pressurized, thereby jetting ink drops from a nozzle hole provided in correspondence to the pressure chamber to thus perform printing.

Generally, an electroconductive aqueous ink is used in an ink jet printer of a DOD type. Therefore, in a shearing mode type with no insulating film as shown in FIG. 15, the driving electrode 4 and the ink come into direct contact with each other, thus causing a short circuit of adjacent driving electrodes or the electrolysis of the ink itself. Hence, it is necessary to apply an insulating film 6 between the ink and a driving electrode 4 as a countermeasure to such short circuiting, as shown in FIG. 14.

It is necessary to connect an external driving circuit and the driving electrode 4 electrically in order to apply voltage to the driving electrode 4. Since high-density printing is performed in an ink jet printer, the layout of the above pressure chamber 1*a* becomes very minute, with approximately a 100 μm pitch. Hence, wiring involves difficulties.

For example, Japanese Laid-Open Patent Publication No. 252750/1988 discloses a method of forming an electroconductive pattern on the upper surface of a piezoelectric base for wiring between a driving electrode and an IC (semiconductor integrated circuit) and from the IC to the exterior. In addition, Japanese Laid-Open Patent Publication No. 182133/1992 discloses a method of providing a shallow connection slot at the end part extended from a slot of a pressure chamber and joining an electrode in such connection slot and an electrode of a circuit base having a driving circuit with a copper foil wire. The driving electrode 4 achieves connection with the IC or copper foil wire electrically (generally at an end part opposite to the ink jetting side). For this, the electroconductive surface of the driving electrode usually must be exposed at a position where such connection is achieved. No insulating film is applied at a position not coming into contact with ink. Alternatively, wiring is conducted after partial removal of an insulating film. In order to apply no insulating film only at a certain position, however, it is necessary to perform a masking operation at such position, and such process is complicated. Also, since the insulating film 6 is formed so as to have a strong adhesion with the driving electrode 4 for preventing a short circuit caused by the permeation of ink, it is very difficult to perform a method of partially removing such insulating film. In addition, even if it is possible to not form the insulating film partially, permeation of ink may easily occur at the interface of the insulating film and the driving electrode with the end of the insulating film as a starting point. This may lead to a problem of peeling at such interface.

Regarding connection with an external driving circuit, to form an electroconductive pattern on a piezoelectric base according to the method of the above Japanese Laid-Open Patent Publication No. 252750/1988 presents serious problems for practical use for the following reasons: (1) a piezoelectric material is extremely easily affected by acid and alkali and it is extremely difficult to perform etching and patterning of a metallic thin film by a photolithography technique; and (2) polarization of a piezoelectric material easily becomes deteriorated due to heat, and it is difficult to perform a process of calcining an electroconductive paste after thick film printing.

On the other hand, according to the method of Japanese Laid-Open Patent Publication No. 182133/1992, a copper foil wire cannot but be made an extremely weak and thin form due to the 100 μm pitch as described above, and there is a large possibility of deformation and breakage. Moreover, the number of copper foil wires to be used for one head is from several tens to one hundred and several tens. Great care and effort is required to put all these copper foil wires into connection slots in the piezoelectric base without breakage during joining. As a result, working efficiency is deteriorated, resulting in a large increase in cost.

Moreover, a conventional shearing mode type has the following problems on deformation of the pressure chamber. Prior art ink jet heads employing the shearing mode are described in Japanese Laid-Open Patent Publication No. 252750/1988, and the construction and operating principle thereof will be described with reference to FIG. 16, FIG. 17 and FIG. 19.

FIG. 19 is an exploded perspective view of an ink jet head employing a shearing mode and includes a plurality of long and thin slots extending in parallel in a piezoelectric material 28 such as PZT (lead zirconate titanate). Upper surface parts of barriers 48*ab* and 48*bc* remaining between adjacent slots are bonded softly to a glass, ceramic or plastic lid 2 by elastic components 3. As a result, the slots become pressure chambers 38*a*, 38*b* and 38*c* filled with ink. One end of each of pressure chambers 38*a*, 38*b* and 38*c* can be supplied with ink from a common ink reservoir (not shown). A nozzle plate 7 with a small nozzle 5 is adhered to the head at other ends of the chambers. The piezoelectric material 28 including barriers 48*ab* and 48*bc* is polarized in one direction as shown by an arrow 8 (or in the reverse direction). Electrodes 18*a*, 18*b* and 18*c* are formed in the internal surfaces of the slots.

FIG. 16 is a schematic sectional view of an ink jet head employing the shearing mode, shown during non-driving. If sufficient large positive electric potential is applied to the electrode 18*a* of FIG. 16, the barrier 48*ab* is caused to deform by a shearing mode due to line of electric force 58*ab* directly crossing and the polarization direction of the piezoelectric material in the barrier as shown in FIG. 17. If the same phenomenon occurs at the barrier 48*bc*, the sectional area of the pressure chamber 38*b* is reduced from the initial condition of FIG. 16 to the condition of FIG. 17. Thus, if the pressure chamber 38*b* is filled with ink, the pressure of ink rises instantaneously by the reduction of the volume of the slot and ink drops are jetted from the nozzle.

In an ink jet head employing a conventional shearing mode, the sectional forms of the bottoms of pressure chambers 38*a*, 38*b* and 38*c* are linear. In order to cause deformation purely of a shearing mode, it is desirable that an electric field between the electrodes 18*a* and 18*b* on both sides of the barrier 48*ab* is concentrated only into the barrier 48*ab*. However, actually, lines of electric force 68*ab* occur by the leakage of an electric field to the barrier 48*ab* and the lower part of the pressure chamber 38*a*. Similarly, lines of electric force 68*bc* occur by the leakage of an electric field to the barrier 48*bc* and the lower part of the pressure chamber 38*c*. Around the bottom part of the pressure chamber 38*b*, since lines of electric force 68*ab* and 68*bc* move in the same direction almost in parallel with the polarization direction of the piezoelectric material at the lower parts of the pressure chambers 38*a* and 38*b*, elongation deformation in the pattern shown by a one-dot chain line occurs, and the bottom part of the pressure chamber 38*b* is lifted up. On the other hand, around the bottom part of the pressure chamber 38*b*, the lines of electric force 68*ab* and the polarization direction of the piezoelectric material become opposite almost in parallel, and shrinkage deformation in such direction occurs. This causes deformation with the bottom being sunken as shown with a one-dot chain line. Such deformation is called a revolution.

Describing the revolution briefly with reference to FIG. 18, the piezoelectric material 28 is deformed as shown by the two-dot chain lines when only the barrier 78*a* is driven to deform the surrounding barriers 78*b* and 78*c* differently from the barrier 78*a*. Since such revolution acts to a direction as to contradict the deformation of a shearing mode of the barrier 48*ab* and the barrier 48*bc*, it reduces jetting power as an ink jet head. However, on the other hand, the bottom part of the pressure chamber 38*b* rises to reduce the sectional area of the pressure chamber, and hence an effect of increasing the jetting power can be anticipated.

The present inventors measured the amount of displacement of the barrier 78*a* by laser measurement with a view to making the balance clear. In an experiment, a very small mirror is adhered onto the upper surface of a barrier. Altering voltage is applied to electrodes on both sides of the barrier. The amount of movement of the mirror is measured according to laser light irradiated onto the mirror, and this is converted into the amount of deformation of the barrier.

According to the results, the amount of change of the volume of the pressure chamber 38*b* in FIG. 17 became considerably small, about two-thirds of the volume change in the case of only an imaginary shearing mode. As a result, ink jetting power is reduced sharply and the jetting speed of ink drops is reduced. The reduction of the jetting speed induces instability of the jetting direction of the ink drops, which not only causes deviation of the position of printed dots but also makes it impossible to jet ink that is made highly viscous around the nozzle, thereby leading to a fatal defect of the dislocation of printed dots.

SUMMARY OF THE INVENTION

It is a first object of the present invention to avoid the above problems involving an insulating film at position of connection of the driving and external electrodes. It is a second object to provide an ink jet head having high reliability and high performance, that is small and that can be produced at low cost by overcoming the above problem of connection with an external circuit.

It is a third object of the present invention to provide an ink jet head capable of reducing revolutions of a piezoelectric material on driving of the head and obtaining printing with high reliability and high quality.

In order to achieve the above first object, an insulating film is formed on a driving electrode of a mounting portion in addition to on a driving electrode of a pressure chamber in the ink jet head of the present invention, and electric connection with an IC or an external electrode is achieved by an electrical joining component containing electroconductive particles of a higher hardness than the insulating film and a larger diameter than the thickness of the insulating film.

According to such arrangement, electric connection between an external electrode and a driving electrode can be achieved while the insulating film is maintained on the driving electrode. Since the above electroconductive particles have a higher hardness and a larger thickness than the insulating film, the electroconductive particles break through the insulating film to reach the driving electrode and at the same time extend from the insulating film to come into contact with the external electrode. Therefore, the driving electrode connects with the external electrode electrically through the electroconductive particles.

A particularly important effect is that the occurrence of various defects due to a short circuit between driving electrodes can be prevented even if undesirable conditions such as ink adhesion and moisture condensation occur at the connection position. This will improve the reliability of the head. The electroconductive particles are protected electrically by the adhesive insulating component forming the electrical joining component. Thus, no problem of reliability of the electroconductive particles occurs. In addition, there is no need to remove part of the insulating film, and the above difficulties of attempting to do so thereby are totally avoided.

In order to achieve the above second object, the present invention employs a pattern electrode formed on a film and connected to the driving electrode in the above manner. Thus, the external electrode is the pattern electrode and fits in a connection slot provided on one end of the piezoelectric base. The thickness of the pattern electrode is larger than the depth of the connection slot by more than 10 μm.

By such arrangement, various advantages to reliability and yield as discussed below can be fulfilled:

(1) adhesion strength between an external electrode and a piezoelectric base is increased;

(2) the probability of the occurrence of a short circuit between adjacent electrodes, which becomes a problem in the case of connections at a minute pitch, can be reduced remarkably with an electrical joining component containing electroconductive particles;

(3) the defect of deviation of the position between a driving electrode and an external electrode can be reduced. Since a film with a pattern electrode is used, defects caused by curving of copper foil wires can be avoided almost entirely.

To accomplish the third object, the sectional shape of the bottom part of a slot of a pressure chamber according to the present invention is formed of a surface that is not right-angled to the polarization direction but that extends thereto to an incline. The sectional shape of a pressure chamber of a conventional ink chamber is right-angled to the polarization direction. The bottom part of a pressure chamber of the invention is recessed. One recessed shape is formed by at least two lines or planes. Another shape is formed of one inclined straight line or plane. Another shape is formed of a line or plane combined with a curved line or surface. It is not always necessary that the form of the bottom part of a pressure chamber be symmetric.

By the above shapes, the action of a revolution due to a leakage electric field at the bottom part of a pressure chamber of a piezoelectric material of a conventional undesirable effect can be controlled by forming the sectional shape of the bottom side of a slot being a pressure chamber to include an inclined side that is not right-angled to a polarization direction.

When the bottom part of the pressure chamber has such a shape, the direction of a line of electric force at the bottom part turns to a right angle to the inclined side and thus extends at an angle to the polarization direction of the piezoelectric material. At this time, the line of electric force is divided into a component that is right-angled to the polarization direction and a component in parallel with such direction. The component that extends at a right angle to the polarization direction exhibits a function causing deformation purely of a shearing mode, and the component in the parallel direction induces a revolution. While all leakage electric fields have acted as a component inducing a revolution in conventional structures since all lines of electric force at the bottom part of a pressure chamber are in parallel with the polarization direction, leakage electric fields in a pressure chamber act also as a component causing a shearing mode in the present invention, and the action of a revolution can be reduced. Since the amount of deformation of barriers between pressure chambers is ensured according to the invention, an ink jet head exhibiting an excellent ink jetting performance can be obtained.

DETAILED DESCRIPTION OF THE INVENTION

The present invention will be described in detail with reference to the attached drawings.

Embodiment 1

Figure 2:
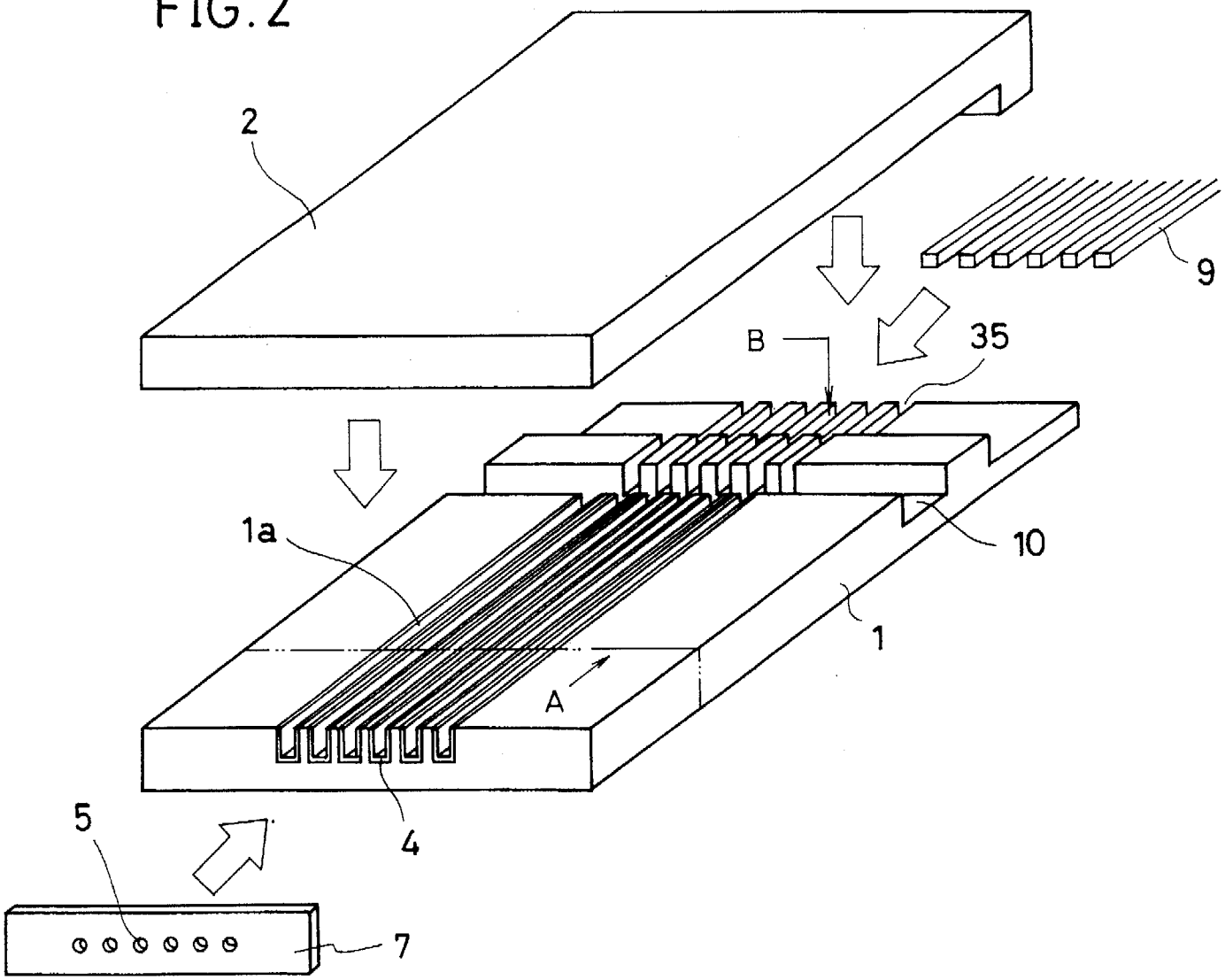
FIG. 2 is an exploded perspective view thereof.

FIG. 2 is an exploded perspective view of an ink jet head according to the present invention. A sheet-like piezoelectric base 1 has a first slot with a rectangular sectional shape forming a pressure chamber 1*a* and a second slot crossing such first slot and forming an ink supply path 10 for supplying ink into such first slot. A driving electrode 4 is formed on the inner wall of the first slot. The driving electrode 4 extends beyond the tip of the ink supply path 10 and forms a shallow connection slot 35 at a rear end part (B part) of the head. An external electrode 9 is mounted in and connected to connection slot 35 of electrode 4. A treatment for preventing ink from flowing between ink supply path 10 and connection slot 35 is performed with a sealing component or the like.

Figure 14:
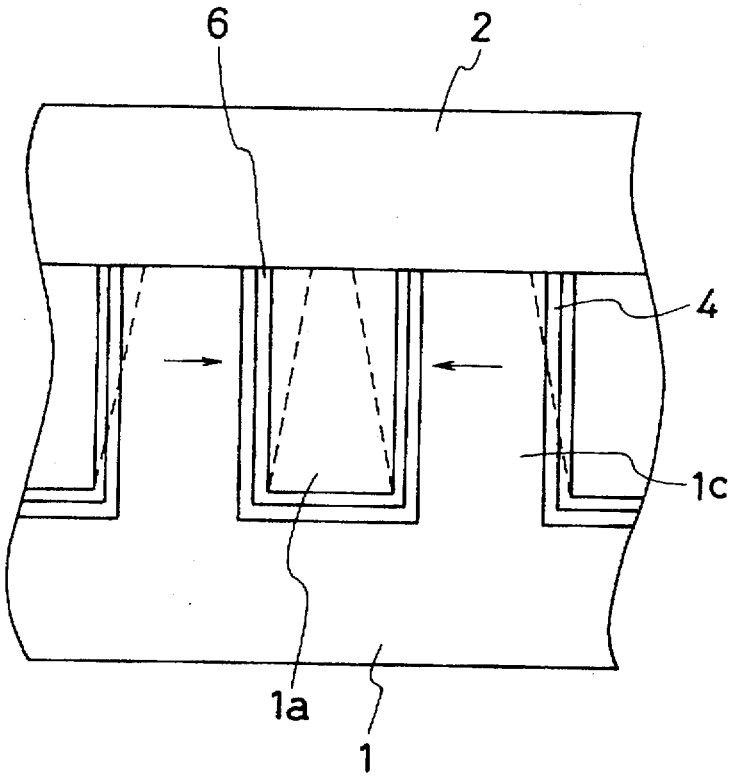
FIG. 14 (PRIOR ART)
FIG. 14 is a sectional view of a pressure chamber of an ink jet head of a conventional shearing mode type.
Figure 15:
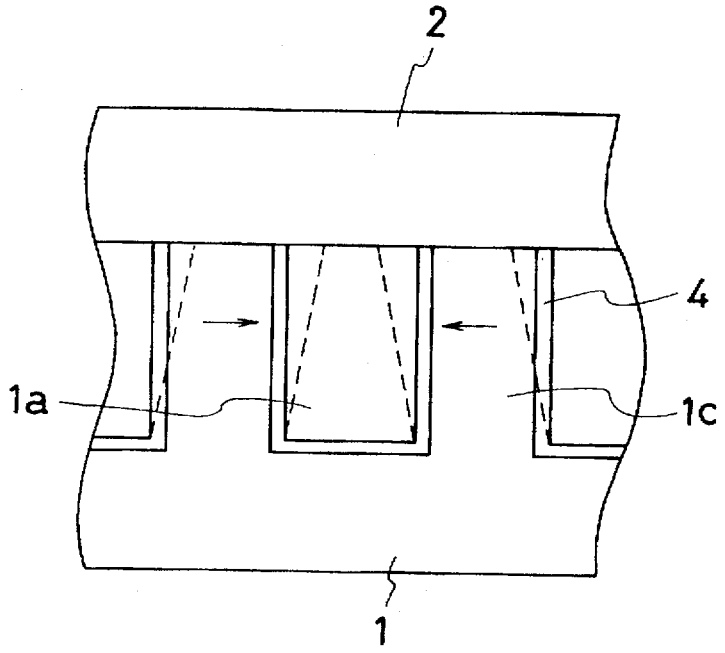
FIG. 15 (PRIOR ART)
FIG. 15 is a sectional view of a pressure chamber of an ink jet head of a conventional shearing mode having no insulating film.

An upper lid 2 is positioned to enclose the first slot to form pressure chamber 1*a*, and a nozzle plate 7 is secured to a front end part of the head so that a nozzle hole 5 is provided in correspondence to pressure chamber 1*a*. Ink introduced into the thus prepared head through the ink supply path 10 is jetted from the nozzle hole 5 as ink drops by changing the pressure of the pressure chamber 1*a* in correspondence to a signal from the external electrode 9. The cross section at the A part shown by a two-dot chain line is identical with that of FIG. 14 of the conventional head.

Figure 1:
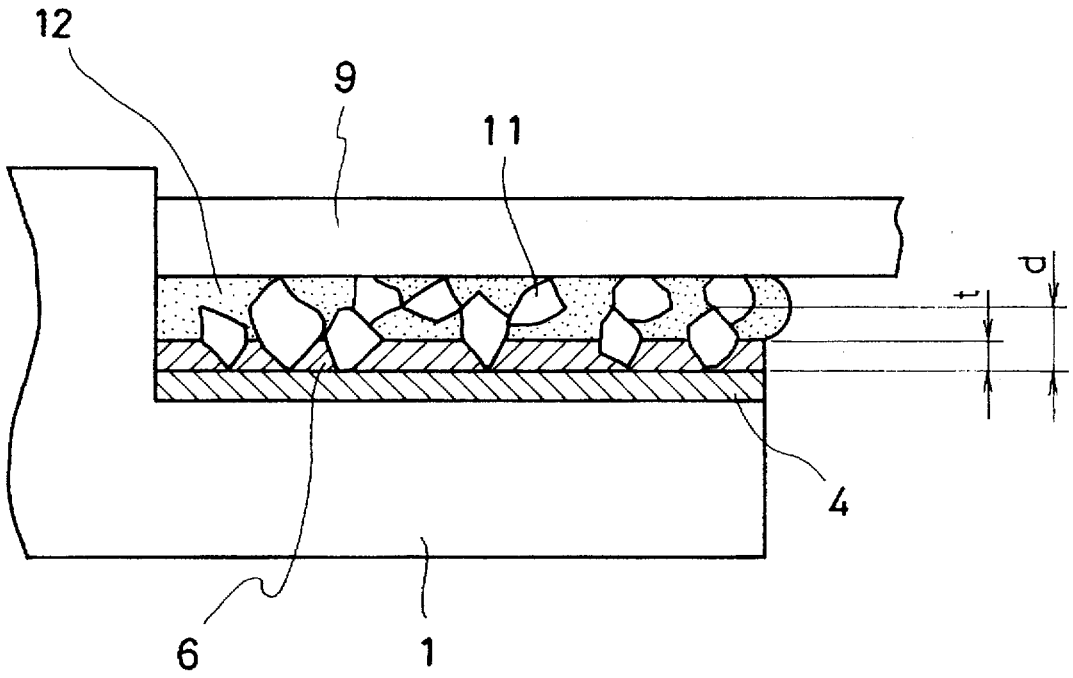
FIG. 1 is a side view of a mounting portion of a first ink jet head according to the present invention.

FIG. 1 is an enlarged side view of the rear end part (B part) of the head of FIG. 2 to explain the present invention in detail.

In the present embodiment, an insulating film 6 is formed on the driving electrode 4, and the external electrode 9 is joined mechanically and electrically with driving electrode 4 by a connector including a joining component 12 containing electroconductive particles 11. As a specific constitution, a gold film with a thickness of 0.3 μm is formed by spattering on the piezoelectric base 1 of PZT (lead zirconate titanate) as the driving electrode 4. Subsequently, poly-para-xylylene with a thickness of 5 μm is formed by chemical metallizing as the insulating film 6. Poly-para-xylylene is a soft film with a Rockwell hardness of R80 (ASTM-D-785) and a pencil hardness of H. The external electrode 9 formed of gold-plated copper foil and the driving electrode 4 are joined electrically by an electrical joining component 12 containing electroconductive particles 11 with an average particle diameter d of 7 μm. Joining component includes an epoxy resin and an aggregate of Ni particles of a hard metal dispersed therein as electroconductive particles 11.

As a mounting process, the above aggregate is cured by heat contact bonding from the top of the external electrode 9 to accomplish mechanical linking. The hard electroconductive particles 11 break the insulating film 6, that is very soft in comparison therewith, by pressurizing thus accomplishing electrical joining between external electrode 9 and driving electrode 4. The reliability of such electrical joining was examined by determining the average particle diameter d of electroconductive particles 11 to 7 μm and changing the thickness of the poly-para-xylylene film. The results are shown in Table 1. When the measured value of resistance between a driving electrode and an external electrode was beyond 1Ω, it was deemed as a defect, and 5 samples having 50 pressure chambers per head were prepared per each film thickness to obtain percentages of defects.

TABLE 1

| Film Thickness (μm) | 3 | 5 | 7 | 9 | 11 |
|---|---|---|---|---|---|
| Defects (%) | 0 | 0 | 2 | 16 | 62 |

It is apparent that it is an important condition for ensuring electrical joining that the particle diameter d of electroconductive particles 11 is larger than the thickness t of the insulating film 6. It is deemed that the driving electrode 4 and the external electrode 9 are electrically connected since electroconductive particles break through the insulating film 6 and pop out from both sides thereof.

To ensure the insulating properties between the ink and the driving electrode 4, it is necessary that the poly-para-xylylene insulating film 6 has a thickness of 1 μm or more, preferably 3 μm or more, and inevitably that d is 1 μm or more, preferably 3 μm or more.

Film 6 can be high polymeric, relatively soft insulating film of polyimide resin, polyamide resin, polyester resin and silicone resin by coating and polyethylene and polystyrene by plasma polymerization.

On the other hand, relatively hard insulating films were formed of about 2 μm of a silicone oxide film with a hardness almost the same as that of Ni. In such case, the percentage of defects corresponding to Table 1 was 5%, and it was revealed that the Ni particles might fail to break through such an insulating film sufficiently in come cases. However, such problem will not occur when a silicone oxide film is formed on the above poly-para-xylylene film, and it can be said that its properties will be dominating if it is used together with a soft film.

It is apparent that these features of this embodiment of the present invention also can be applied to an electrode with an insulation on the inner surface of a lid of an expanding mode type disclosed in Japanese Laid-Open Patent Publication No. 159358/1984.

The above can be applied between a bump formed on an IC and an electrode on a piezoelectric base also in a connection with an IC disclosed in Japanese Laid-Open Patent Publication No. 252750/1988.

Embodiment 2

Figure 3:
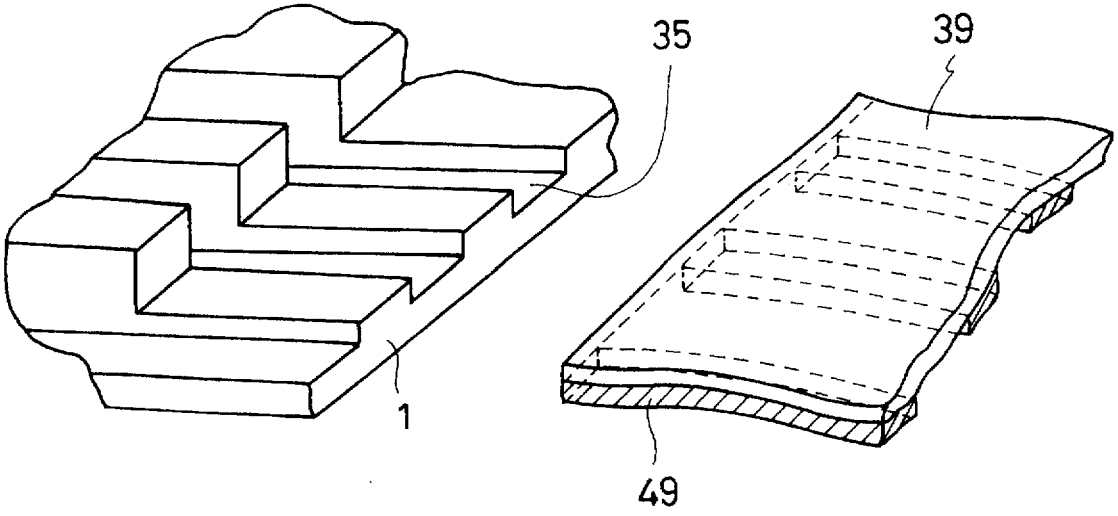
FIG. 3 is an exploded perspective view of a mounting portion of a second ink jet head according to the present invention.

FIG. 3 is a perspective view showing a part corresponding to B part of FIG. 2 of another embodiment of the present invention.

A slot extending from a pressure chamber 1*a* is formed to be a shallow connection slot 35 at the back end part of a piezoelectric base 1, and a driving electrode 4 and an insulating film 6 thereupon are formed in connection slot 35. This portion is similar to that of FIG. 2. On the other hand, it is an important point of the present invention that an external electrode has a pattern electrode 49 on a film 39, which is flexible wiring.

Figure 4:
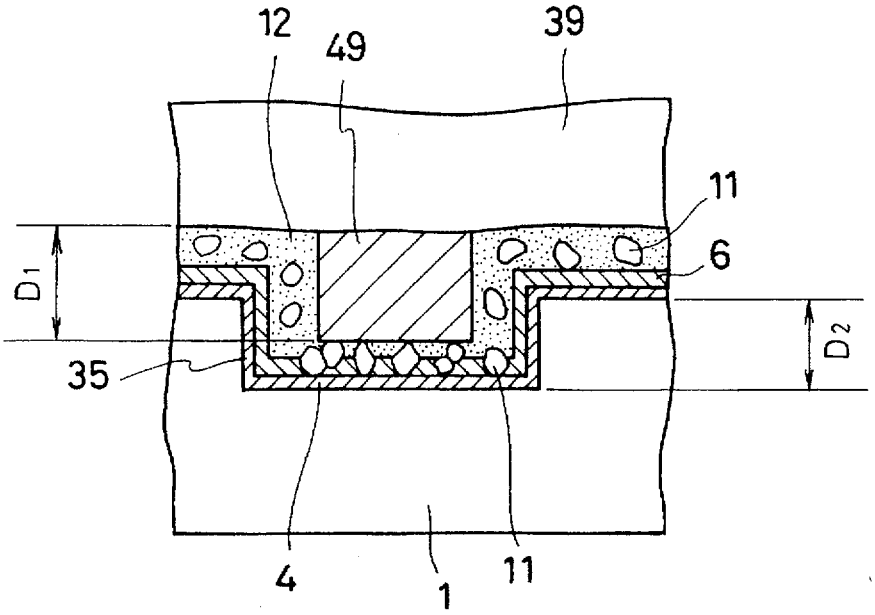
FIG. 4 is a sectional view thereof.

FIG. 4 is an enlarged sectional view of an ink jet head shown in FIG. 3 around the connection slot. The pattern electrode 49 is mounted within the connection slot 35, and, as described above, electrode 49 and driving electrode 4 can be connected electrically by electroconductive particles 11.

In a heat contact bonding process for curing electrical joining component 12 containing electroconductive particles 11, press heating is performed in one lot with a hot tool from the top of the film 39. At this time, the space between the part without the pattern electrode 49 on the lower surface of the film 39 and the surface of the piezoelectric base 1 is filled with joining component 12 that becomes cured. Therefore, mechanical joining strength between film 39 with pattern electrode 49 and the piezoelectric base 1 is enhanced sharply.

Compared with the case of joining with a plain electrode surface, it is advantageous particularly in a liquid crystal panel and the like that the volume of the space between pattern electrodes is very small according to the constitution of the present invention and is filled with the joining component 12 effectively.

In addition, the electrical joining component 12 containing electroconductive particles 11 is a so-called anisotropic electroconductive component capable of obtaining electroconductivity in a direction of thickness but expressing insulating properties in a planar direction. According to the constitution of the present invention, however, the performance of expressing insulating properties in the planar direction is improved even in case of a minute pitch since adjacent electrodes are separated by the three-dimensional slots. Besides, relative positioning between the pattern electrode 49 and the connection slot 35 becomes easy due to the fitting structure. Moreover, in comparison with the external electrode of FIG. 2, a lot of wiring electrodes can be handled stably since the pattern electrodes 49 are fitted with the film 39.

Figure 5:
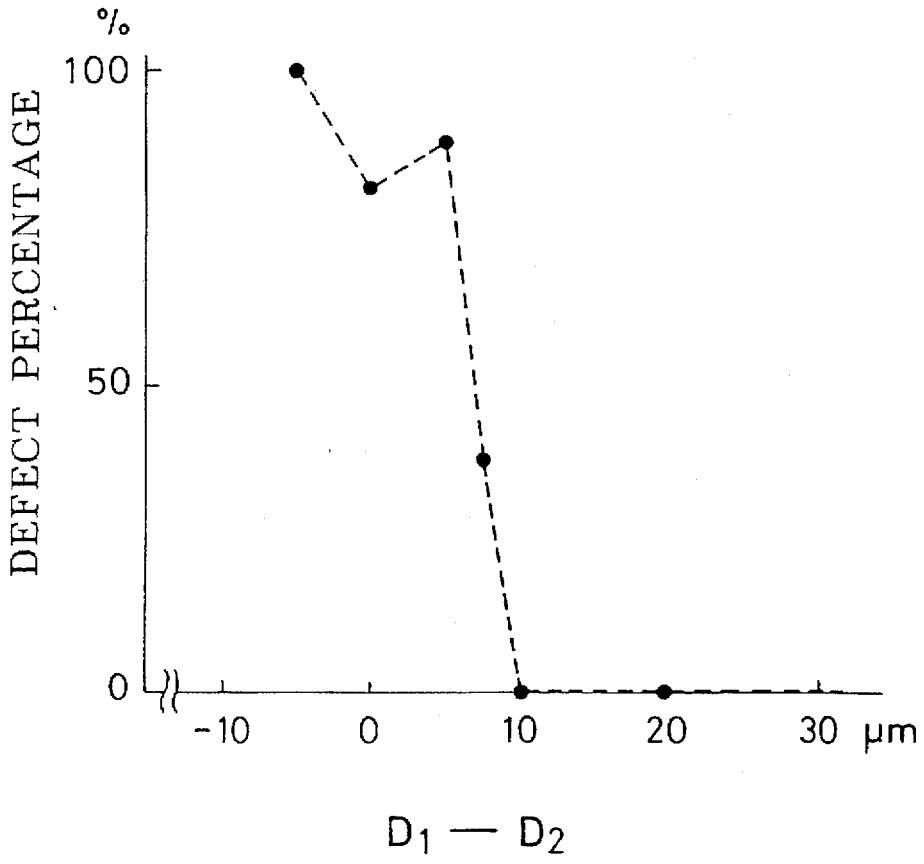
FIG. 5 is a graph illustrating characteristics thereof.

The influence of the difference between the thickness D1 of the pattern electrode 49 and the depth D2 of the connection slot 35 on mounting was examined. The results are shown in FIG. 5.

The transverse axis shows values of D1–D2 according to various constitutions and the vertical axis shows percentages of conductive defects. The measurement of conductive defects was performed in the same manner as in Table 1. It is apparent according to the results that when the value of D1–D2 is more than 10 μm, that is, when the thickness of the above pattern electrode 49 is larger than the depth of the above connection slot 35 by at least 10 μm, excellent electrical joining can be accomplished.

Embodiment 3

Next, an embodiment related to a pressure chamber of an ink jet head according to the present invention will be described with reference to FIG. 6 that corresponds to FIG. 16 of the conventional structure. Pressure chambers 30*a*, 30*b* and 30*c* related to ink jetting correspond to pressure chambers 38*a*, 38*b* and 38*c* of FIG. 16, respectively. Similarly to FIG. 16, a nozzle 5 is provided at the end part of each pressure chamber.

The difference of this embodiment from conventional structures is that a recess 70 is provided at the bottom part of each of pressure chambers 30*a*, 30*b* and 30*c*. In FIG. 6, the sectional shape of the recess 70 at the bottom part of each pressure chamber is formed of at least two intersecting planar surfaces or lines. Particularly both lines are rectilinear, and the right and left lines are almost symmetric. Electrodes 4*a*, 4*b* and 4*c* are formed on the internal surfaces of the pressure chambers.

Figure 7:
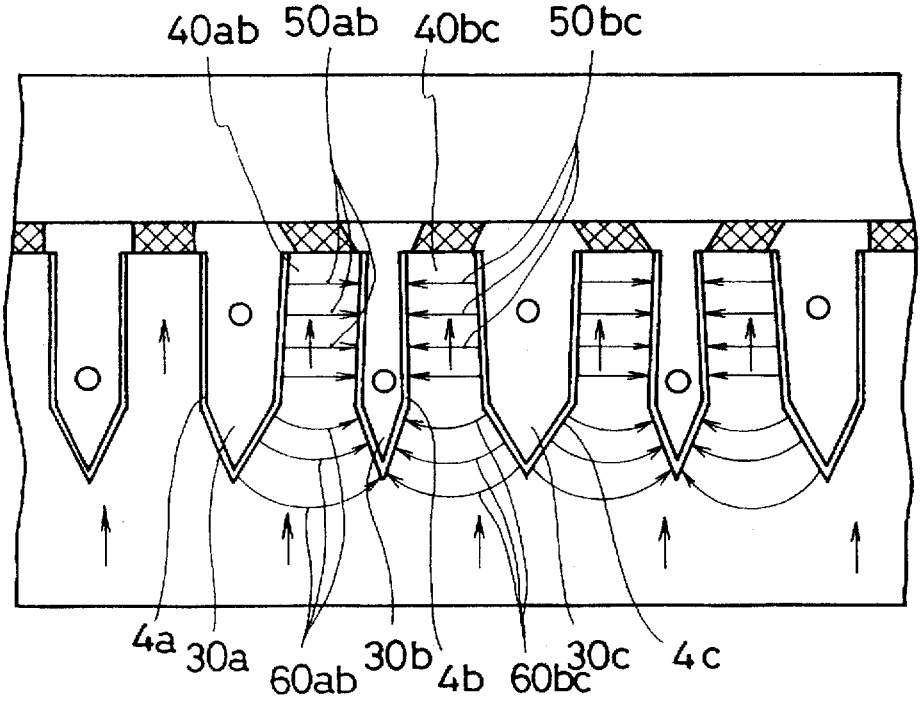
Figure 17:
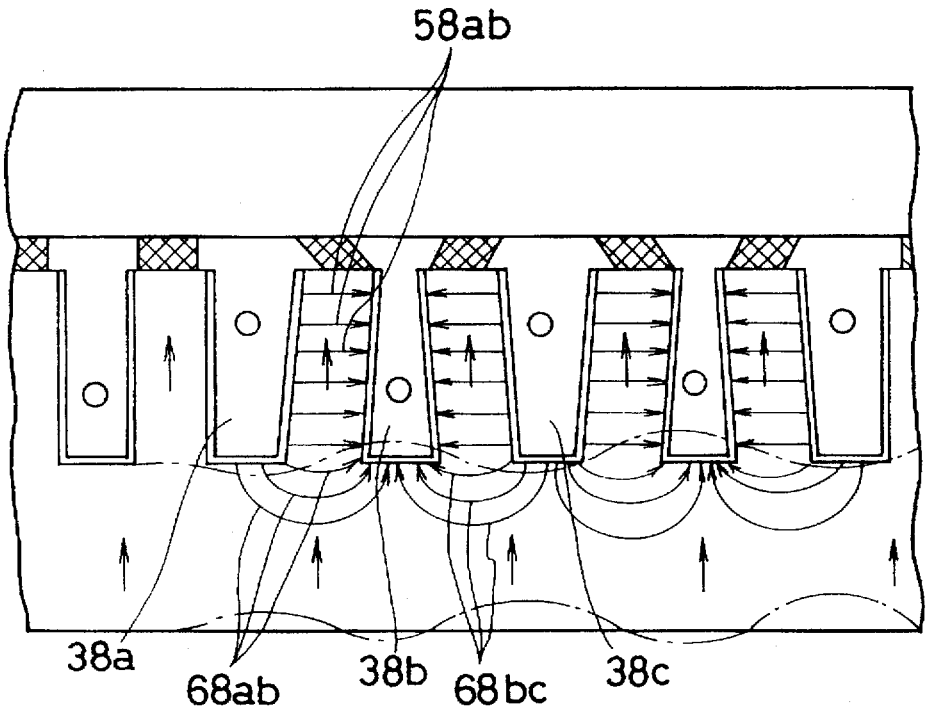
FIG. 17 (PRIOR ART)
Figure 18:
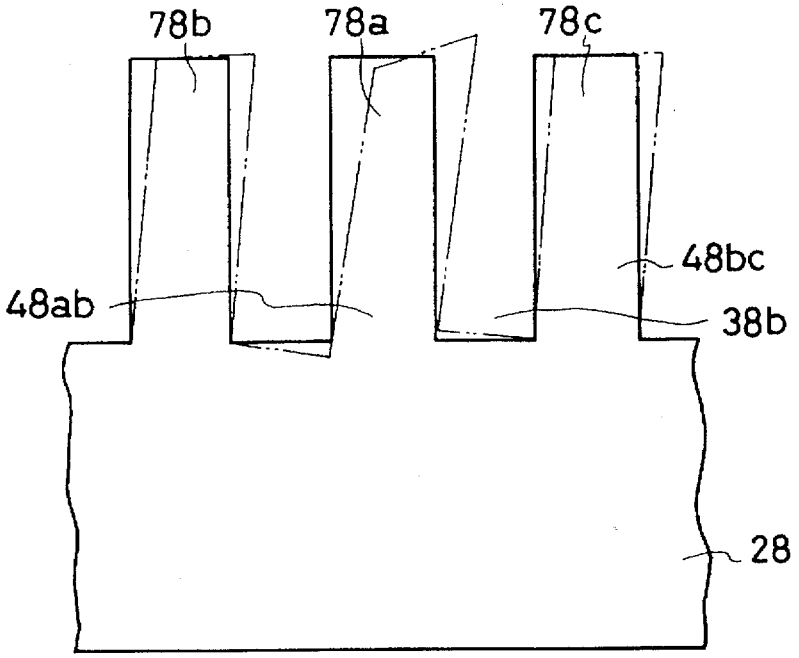
FIG. 18 (PRIOR ART)
Figure 19:
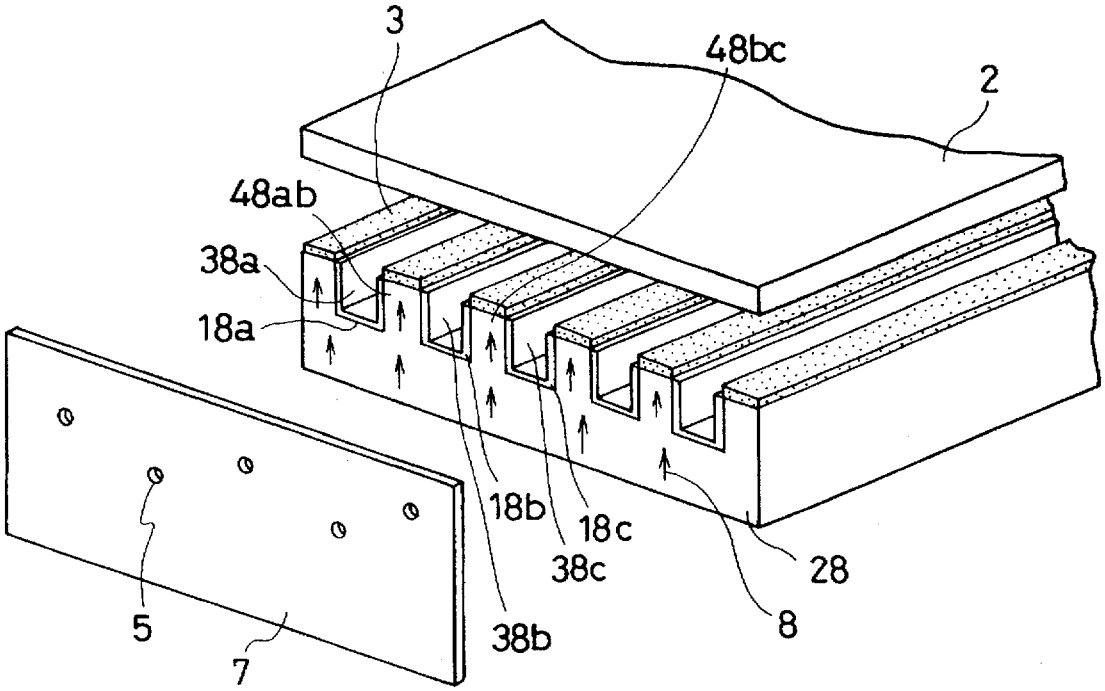
FIG. 19 (PRIOR ART)

FIG. 7 is an explanatory view illustrating the effect of the present embodiment, and corresponds to FIG. 17 of a conventional example. If sufficiently large positive potential is applied to the electrode 4*b*, the line of electric force 50*ab* in the barrier 40*ab* is formed so that it crosses with the polarization direction of piezoelectric material thereof, and the barrier 40*bc* causes the deformation of a shearing mode similarly to the case of FIG. 17. Similarly to FIG. 17, the sectional area (volume of the flow path of the pressure chamber 30*b*) of the pressure chamber 30*b* related to ink jetting is reduced according to the deformation of a shearing mode of barriers 40*ab* and 40*bc* to cause ink to jet out of the nozzle 5.

A function of controlling a revolution at the bottom part of a pressure chamber of a piezoelectric material, an effect of the present invention, will be described. As explained with reference to FIG. 17, a revolution operating to contradict the deformation of barriers by a shearing mode occurs by a leakage electric field at the bottom part of the piezoelectric material 1. A leakage electric field will be described again relative to the present embodiment with reference to FIG. 7.

In the present embodiment, the lines of electric force caused by a leakage electric field curve from a slope at the right side of the bottom part of the pressure chamber 30*a* (side having a certain direction not right-angled to the polarization direction of the piezoelectric material) to a slope at the left side of the bottom part of the pressure chamber 30*b*, as shown by lines of electric force 60*ab*. Lines 60*bc* are symmetric on the opposite side of chamber 30*b*. Such will be described with reference to FIG. 8 that is an enlarged view of the bottom part of a pressure chamber. The direction of the end point of the line of electric force 60*ab* shown in FIG. 7 is expressed as the direction vector A. The direction vector A can be divided into two directional components of vector X and vector Y.

The vector X is a vector component in a direction of crossing with the polarization direction of the piezoelectric material. Thus, the vector X functions purely in a direction aiding a shearing mode. On the other hand, the vector Y is a vector component in parallel with the polarization direction of the piezoelectric material. Thus, the vector Y functions in a direction inducting a revolution.

Figure 16:
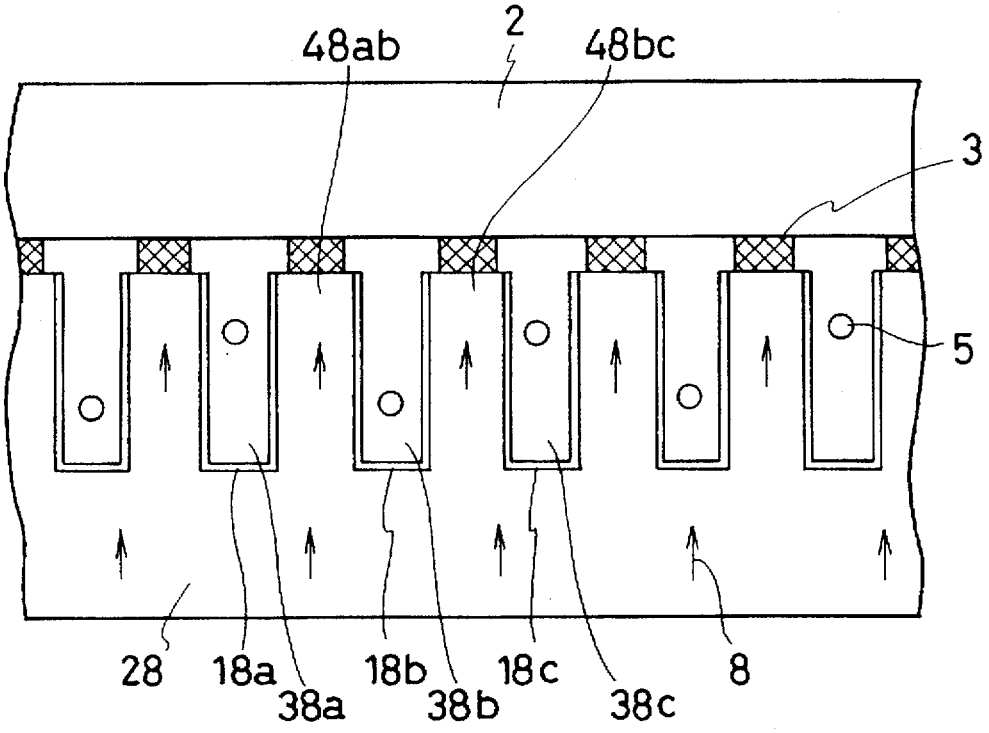
FIG. 16 (PRIOR ART)
FIGS. 16–19 show a conventional ink jet head employing a shearing mode, FIG. 16 being a schematic view during non-driving, FIG. 17 being a schematic view during driving, FIG. 18 being an enlarged view showing the condition of deformation of barrier of a piezoelectric material and surrounding barriers upon driving, and FIG. 19 being an exploded perspective view.

When the sectional form of the bottom of a slot is formed by a line or planar surface transverse to the two side walls of the slot, as shown in FIG. 16 and FIG. 17, the direction vector of the end point of a line of electric force is only a component in a direction of the vector Y with no component corresponding to the vector X.

In comparison of the embodiment according to the present invention with conventional examples, when the sectional form of the bottom part of a slot is formed of at least two intersecting surfaces or lines, force upon the bottom part of the slot given by a line of electric force occurring on application of voltage is dispersed into two directions, and the value of the component Y inducing a revolution becomes smaller as a whole than in the case that the sectional form of the bottom part of a slot is composed of one planar transverse surface or straight line. On the other hand, though the explanation has been performed about the end point of the line of electric force 60*ab*, the same can be said about the starting point.

In addition, when the bottom part of a pressure chamber of the piezoelectric material 1 is almost bisymmetric, a revolution, one influence of a leakage electric field between the electrodes 4*a* and 4*b*, is caused by a leakage electric field influenced by the right half of the electrode 4*a* mounted in the pressure chamber 30*a*. Regarding an element as a leakage electric field influenced by the left half of the electrode 4*a*, the length of a line of electric force produced by the left half of the electrode 4*a* and the electrode 4*b* becomes very long and can be disregarded compared with an influence by the right half of the electrode 4*a*. Thus, the range of influence of a leakage electric field is reduced by about ⅔ in the present invention in comparison with a conventional structure in which the bottom part of a pressure chamber is linear.

Embodiment 4

Figure 9:
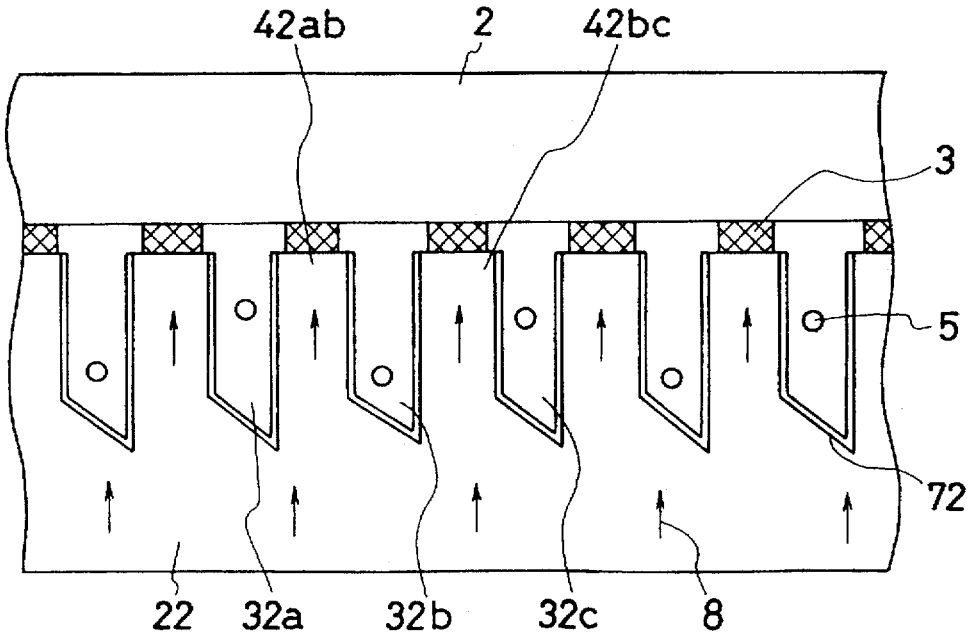
FIGS. 9–11 are views similar to FIGS. 6–8, respectively, of a pressure chamber of an ink jet head according to the present invention.

FIG. 9 corresponds to FIG. 16 of a conventional example and shows another embodiment of an ink jet head according to the present invention. Pressure chambers 32*a*, 32*b* and 32*c* correspond to ink chambers 38*a*, 38*b* and 38*c* of FIG. 16, respectively. Similar to FIG. 16, a nozzle 5 is provided at the end part of each pressure chamber.

The difference between the present embodiment and the conventional arrangement is that a recess 72 is provided at the bottom part of each of ink chambers 31*a*, 32*b* and 32*c*. In FIG. 9, the sectional shape of the recess 72 at the bottom part of a pressure chamber is composed of one inclined planar surface or straight line, and hence the shape is non-symmetric.

Figure 10:
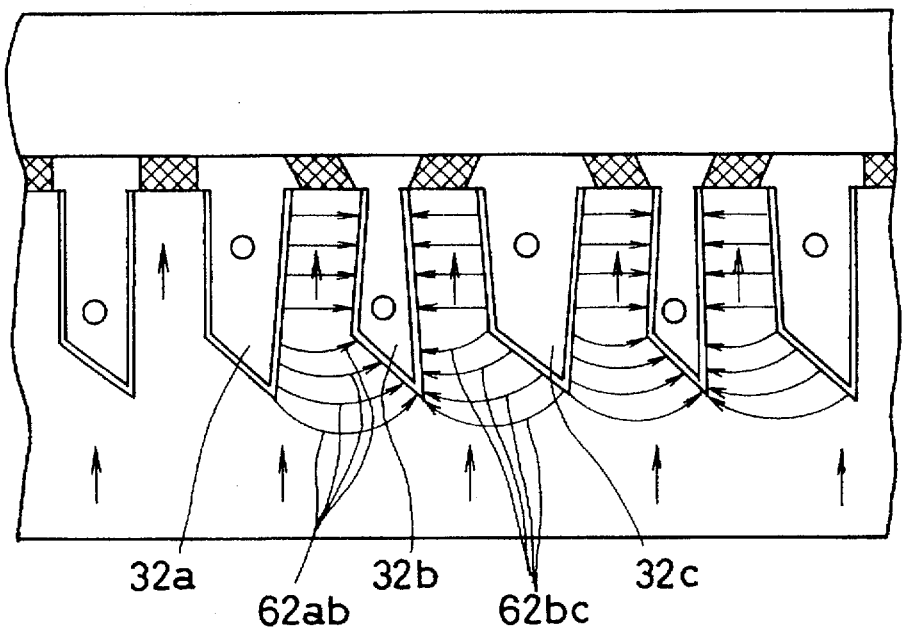

FIG. 10 is an explanatory view of the function of the present embodiment and corresponds to FIG. 17 of a conventional shape.

A function of controlling a revolution at the bottom part of an ink chamber of a piezoelectric material, an effect of the present invention, will be described. First of all, a revolution operating so as to contradict the deformation of a barrier by a shearing mode will be described referring to FIG. 10.

A line of electric force caused by a leakage electric field becomes a curve from a side almost right-angled to the polarization direction of the piezoelectric material to a side with a certain angle (or in reverse) as shown by lines of electric force 62*ab* and 62*bc*. Such function will be described with reference to FIG. 11 that is an enlarged view of the bottom part of a pressure chamber.

Figure 11:
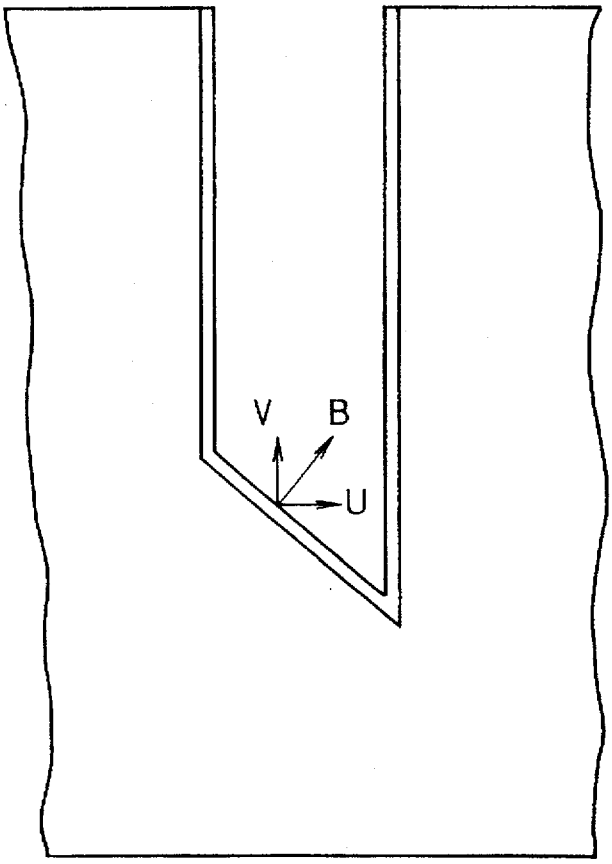

The vector at the end point of the line of electric force 62*ab* shown in FIG. 10 is expressed as the direction vector B (FIG. 11). The direction vector B can be divided into two directional components of the vector U and the vector V. The vector U is a vector component in a direction crossing the polarization direction of the piezoelectric material. Thus, the vector U functions purely in a direction aiding a shearing mode. On the other hand, the vector V is a vector component in parallel with the polarization direction of the piezoelectric material. Thus, the vector V functions in a direction inducing a revolution.

When the sectional form of the bottom part of a slot is composed of a line or surface that is transverse and has no slope (FIG. 16, FIG. 17), the direction vector at the end point of a line of electric force is only a component in a direction of the vector V with no component corresponding to the vector U.

In the present embodiment, when the sectional form of the bottom part of a slot is composed of a slanted straight line or planar surface, force upon the bottom part of the slot given by a line of electric force occurring on application of voltage is dispersed into two directions, and the value of the component Y inducing a revolution becomes smaller as a whole than in the case that the sectional form of the bottom part of a slot is composed of one transverse straight line or surface with no slope.

Figure 6:
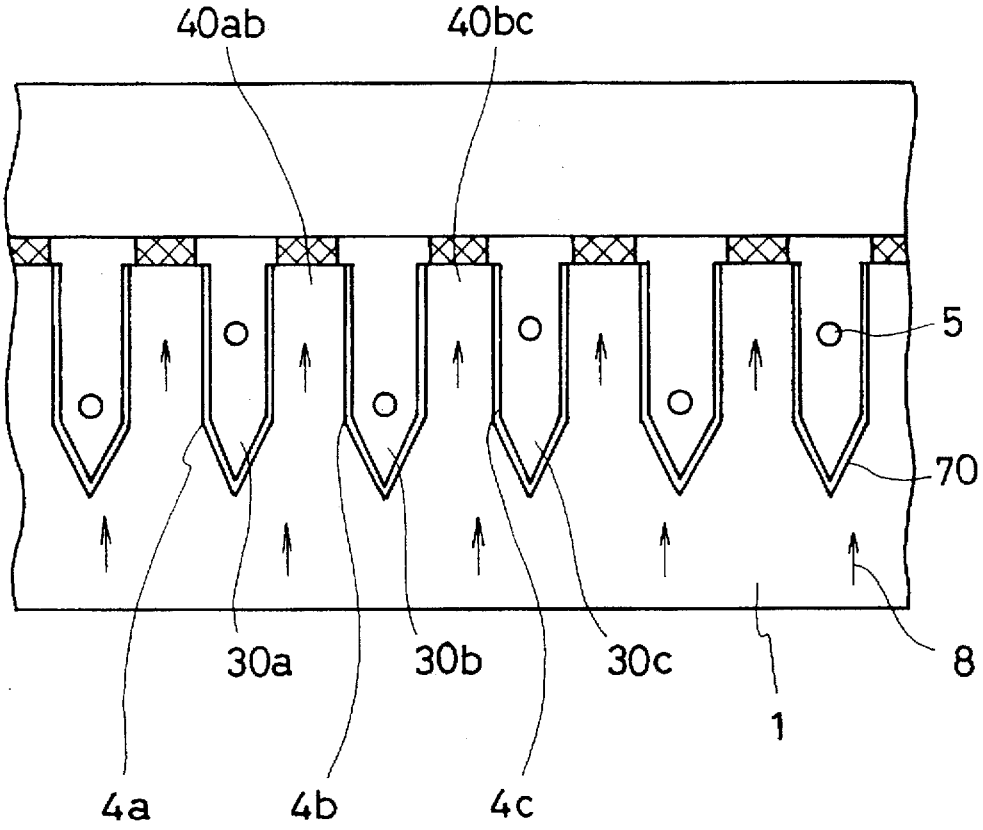
FIGS. 6–8 show an embodiment of a pressure chamber of an ink jet head according to the present invention, FIG. 6 being a schematic view thereof during non-driving, FIG. 7 being a similar view during driving, and FIG. 8 being an enlarged view of a part of a barrier.
Figure 8:
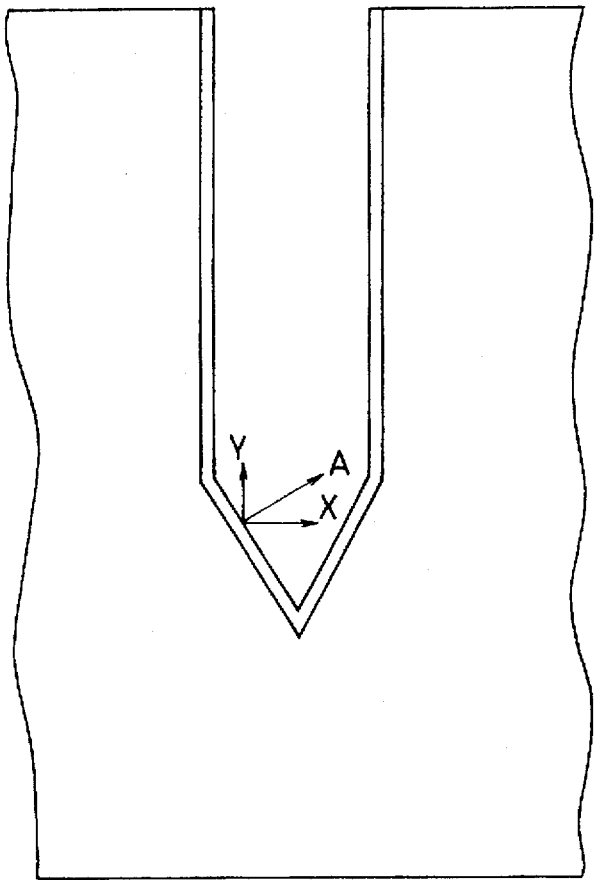

The present embodiment can obtain the same effect as in the embodiments shown in FIGS. 6–8. Since a vector component at the end point becomes almost right-angled to a polarization direction, deformation purely of a shearing mode occurs.

Next, non-symmetry of the bottom part of a pressure chamber in a piezoelectric material 22 will be described. When a pressure chamber has a bottom part composed of one slanted straight line as shown in FIG. 10, the right side of the pressure chamber 32*a* is linear and hence a component causing deformation purely of a shearing mode is very large. Hence, most components of revolution are at the left side, and components of a revolution can be reduced as a whole.

Thus, it is not always necessary that the form of the bottom part of a pressure chamber be symmetric.

Embodiment 5

Figure 12:
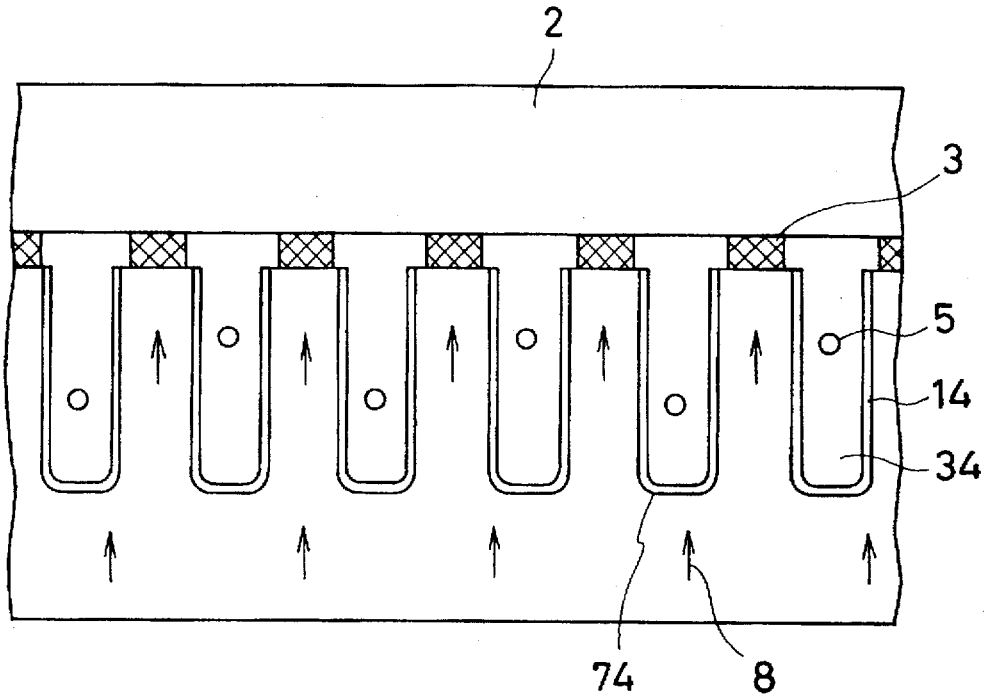
FIG. 12 is a schematic view of another embodiment of a pressure chamber of an ink jet head according to the present invention, shown during non-driving.

FIG. 12 corresponds to FIG. 16 of a conventional example and shows the constitution of another embodiment of a pressure chamber of an ink jet head according to the present invention. An ink chamber 34 for ink jetting corresponds to ink chambers 38*a*, 38*b* and 38*c* of FIG. 16. Similarly to FIG. 16, a nozzle 5 is provided at the end part of each ink chamber.

The difference of the present embodiment according to the present invention from conventional examples is that a recess 74 is provided at the bottom part of the pressure chamber 34. In case of FIG. 12, the shape of the recess 74 at the bottom part of a pressure chamber is composed of two curved sides or surfaces and one straight line or surface. Since the bottom part of a slot has a curved side, the direction of a line of electric force on a curve formed by applying voltage on an electrode 14 becomes normal, and since the direction vector of the line of electric force has a horizontal direction component in a polarization direction, the same effect as in Embodiment 3 (FIGS. 6–8) can be obtained.

Here, a leakage electric field at the curved part of the bottom part of an ink chamber causes a revolution function slowly as it turns to the bottom part of the pressure chamber 34, which has another effect of causing deformation of a smooth shearing mode since the point of a deformation function purely of a shearing mode comes upward in the recess of the bottom part of a pressure chamber. In the present embodiment, it is also not always necessary that the configuration be bisymmetric, as described in Embodiment 4 (FIGS. 9–11).

Embodiment 6

Figure 13:
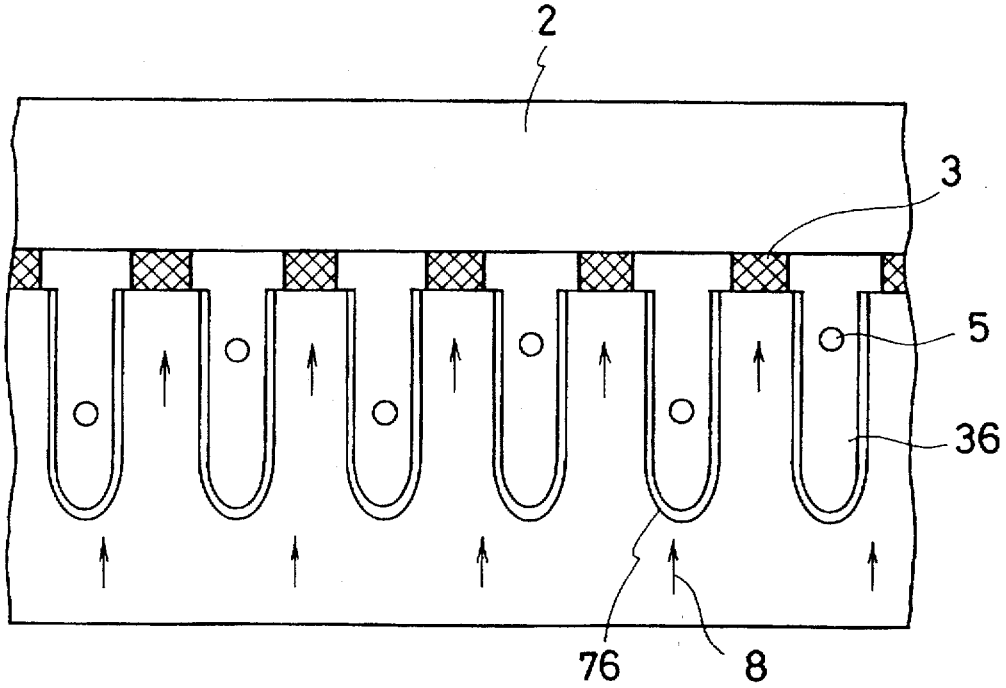
FIG. 13 is a similar view of another embodiment of a pressure chamber of an ink jet head according to the present invention.

FIG. 13 corresponds to FIG. 16 of a conventional example and shows another embodiment of a pressure chamber of an ink jet head according to the present invention. A pressure chamber 36 for ink jetting corresponds to ink chambers 38*a*, 38*b* and 38*c* of FIG. 16. Similarly to FIG. 16, a nozzle 5 is provided at the end part of each pressure chamber.

The difference of the present embodiment from conventional examples is that a recess 76 is provided at the bottom part of the pressure chamber 36. In the present embodiment, the recess form of the recess 76 at the bottom part of a slot is formed of a continuously curved line or surface. The only difference from Embodiment 5 is that the present embodiment contains no straight line or surface, and the same effect as in Embodiment 3 can be obtained. Moreover, the recess may be non-symmetric, similar to Embodiments 4 and 5.

As described above, according to the present invention, electrical connection can be accomplished, through an insulating film, between an electrode at the side of an ink jet head and an external electrode. As a result, not only can a mounting process or operation be simplified, but also an ink jet head with high reliability can be obtained in which a problem of a short circuit due to adhesion of ink or the like is avoided by maintaining an insulating film in its entirety.

Moreover, the invention can be applied to a head of a more minute pitch by employing a film with a pattern electrode. Thus, it is possible to accomplish miniaturization of an ink jet head, with resultant higher reliability and lower price thereof.

As described above, according to the present invention, it becomes possible to allow a part needing no insulating film on an electrode to have no insulating film according to a masking treatment or the like or to omit a process of removing part of an insulating film after application thereof. Hence a wiring operation can be simplified.

In addition, since it never occurs that an insulating film cannot be removed perfectly, reliability of mounting is improved remarkably. Also, in an ink jet head according to the present invention, the sectional form of a bottom part of a slot forming an ink chamber and pressure chamber is composed of a slope or curve or incline that is not vertical to a polarization direction. More precisely, the bottom part of an ink chamber has a recessed portion, the shape of which is composed of at least two lines. One line may be inclined or slanted and straight or one line may be curved.

Since the direction of a line of electric force at the bottom part is normal to a slope and has an angle to the polarization direction of a piezoelectric material, the line of electric force can be divided into a direction component vertical to a polarization direction and a component in parallel therewith. The vertical direction component causes deformation purely of a shearing mode and the parallel direction component induces a revolution.

The function of a revolution can be reduced and an effect of a shearing mode can be obtained in the present invention.

According to the invention, the deterioration of ink jetting power is reduced, thus avoiding a decrease of jetting speed of ink drops. Further, ink that is highly viscous around a nozzle also can be jetted.

What is claimed is:

1. An ink jet head for an ink jet printer, said ink jet head comprising:

a base formed of piezoelectric material;

a slot formed in said base and forming a pressure chamber to contain ink and from which ink is to be jetted;

a driving electrode positioned within said slot for imparting driving pressure to jet ink therefrom;

an insulating film covering said driving electrode to electrically insulate said driving electrode from the ink;

an external electrode; and a connector electrically and mechanically connecting said external electrode to said driving electrode, said connector comprising a joining component covering said insulating film and mechanically joining said external electrode thereto and a plurality of electroconductive particles contained in said joining component, said particles having an irregular and non-spherical configuration, some of said particles contacting said external electrode, and some of said particles penetrating through said insulating film and contacting said driving electrode, thereby electrically connecting said external electrode to said driving electrode.

2. An ink jet head as claimed in claim 1, wherein said joining component comprises a layer of epoxy resin.

3. An ink jet head as claimed in claim 1, wherein said particles have a size greater than a thickness of said insulating film and a hardness greater than a hardness of said insulating film.

4. An ink jet head as claimed in claim 1, wherein said external electrode is connected to said driving electrode at a shallow part of said slot.

5. An ink jet head as claimed in claim 1, wherein said external electrode comprises a pattern electrode formed on a film.

6. An ink jet head as claimed in claim 5, wherein said pattern electrode has a thickness greater than a depth of said slot by at least 10 μm.

7. An ink jet head as claimed in claim 1, wherein said insulating film is formed of poly-para-xylylene.

8. An ink jet head as claimed in claim 1, wherein a bottom portion of said slot has a recessed shape as viewed in transverse section.

9. An ink jet head as claimed in claim 8, wherein said shape is defined by two planar walls converging from respective parallel side walls of said slot.

10. An ink jet head as claimed in claim 9, wherein said two planar walls are symmetric and intersect.

11. An ink jet head as claimed in claim 8, wherein said shape is defined by a single planar wall extending at respective non-right angles to parallel side walls of said slot.

12. An ink jet head as claimed in claim 8, wherein said shape is at least partially defined by a curved surface.

13. An ink jet head as claimed in claim 1 comprising a plurality of parallel slots formed in said base, each said slot defining a respective said chamber and having therein a respective said driving electrode connected to a respective said external electrode by a respective said connector.

14. An ink jet head as claimed in claim 13, wherein each said driving electrode covers a bottom wall and opposite side walls of said respective slot, and a top of said slot is covered by a lid.

15. An ink jet head as claimed in claim 13, wherein adjacent said slots are separated by respective barriers of said piezoelectric material of said base.

16. An ink jet head as claimed in claim 15, wherein each said slot has a bottom portion of a recessed shape as viewed in transverse section.

17. An ink jet head as claimed in claim 16, wherein said shape is defined by two planar walls converging from respective parallel side walls of said slot.

18. An ink jet head as claimed in claim 17, wherein said two planar walls are symmetric and intersect.

19. An ink jet head as claimed in claim 16, wherein said shape is defined by a single planar wall extending at respective non-right angles to parallel side walls of said slot.

20. An ink jet head as claimed in claim 16, wherein said shape is at least partially defined by a curved surface.

21. A method of producing an ink jet head for an ink jet printer, said method comprising the steps of:

providing a base of piezoelectric material having therein a slot forming a pressure chamber to contain ink and from which ink is to be jetted, with said slot having positioned therein a driving electrode for imparting driving pressure to jet ink therefrom, and with an insulating film covering said driving electrode to electrically insulate said driving electrode from the ink; and electrically and mechanically connecting an external electrode to said driving electrode by covering said insulating film with a joining component containing therein a plurality of electroconductive particles having an irregular and non-spherical configuration, a size greater than a thickness of said insulating film and a hardness greater than a hardness of said insulating film, pressing said external electrode into said joining component while applying heat thereto, thus forcing some of said particles to contact said external electrode and forcing some of said particles to penetrate through said insulating film and to contact said driving electrode, and thereby electrically connecting said external electrode to said driving electrode.

22. A method as claimed in claim 21, wherein said joining component comprises a layer of epoxy resin, and the step of applying heat further comprises the step of curing said epoxy resin, thereby mechanically connecting said external electrode to said driving electrode.

23. A method as claimed in claim 21, further comprising the step of providing said external electrode with a thickness greater than a depth of said slot by at least 10 μm.

24. A method as claimed in claim 21, further comprising the step of providing said insulating film of poly-para-xylyene.

* * * * *